United States Patent [19]

Cratin, Jr.

[11] 4,260,363

[45] Apr. 7, 1981

[54] FURNACE FUEL OPTIMIZER

[75] Inventor: John R. Cratin, Jr., Texas City, Tex.

[73] Assignee: Standard Oil Company (Indiana), Chicago, Ill.

[21] Appl. No.: 17,390

[22] Filed: Mar. 5, 1979

[51] Int. Cl.[3] ..... F23N 5/00

[52] U.S. Cl. ..... 431/76; 431/19; 431/20; 122/356

[58] Field of Search ..... 431/19, 20, 76; 122/356

[56] References Cited

U.S. PATENT DOCUMENTS

| | | | |
|---|---|---|---|
| 2,426,733 | 2/1947 | Von Wiesenthal | 122/356 |
| 3,121,420 | 2/1964 | Zimmerman | 122/356 |
| 3,503,553 | 3/1970 | Schomaker | 431/76 |
| 3,610,792 | 10/1971 | Risse | 431/76 |
| 3,947,217 | 3/1976 | Graat et al. | 431/76 |
| 4,102,627 | 7/1978 | Reed et al. | 431/19 |
| 4,150,939 | 4/1979 | Hayes | 431/76 |

*Primary Examiner*—Joseph Man-Fu Moy

*Attorney, Agent, or Firm*—Lansing M. Hinrichs; William T. McClain; William H. Magidson

[57] ABSTRACT

This invention relates to a furnace equipped with a fuel optimizer for more effectively controlling fuel consumption in the furnace and a method for using the furnace fuel optimizer. In particular, the invention relates to a furnace fuel optimizer which controls combustion air by maximizing radiant section heat transfer with respect to convective section heat transfer while monitoring CO emissions in the flue gas and monitoring the draft below the convective section in order to obtain an optimum control value. The furnace fuel optimizer then regulates the furnace to correspond to the optimum control value by adjusting the air input to the furnace so that continuous furnace operation is possible at maximum efficiency.

5 Claims, 2 Drawing Figures

FURNACE FUEL OPTIMIZER

BACKGROUND OF THE INVENTION

1. Field of the Invention

This invention relates to a furnace equipped with a fuel optimizer for more effectively controlling fuel consumption in the furnace and a method for using the furnace fuel optimizer. In particular, the furnace fuel optimizer is designed to control combustion by maximizing radiant section heat transfer with respect to convective section heat transfer while monitoring CO emissions in the flue gas and monitoring the draft below the convective section in order to obtain an optimum control value. The optimizer then regulates the furnace to correspond to the optimum control value by adjusting the air input to the furnace so that continuous furnace operation is possible at maximum efficiency.

2. Description of the Prior Art

Furnaces, or process heaters as they are sometimes referred to, are used by industries to elevate the temperature of various fluids and gases by passing these fluids and gases through hollow tubular tubes or coils which are enclosed in the furnace. When the fluid or gas absorbs an adequate amount of heat, it is transferred away to another unit for further processing. In an oil refinery, normally over half of the total fuel consumption is attributable to the firing or heating of such furnaces. Most of this heat is used to generate steam or to heat various feed streams, for example, a crude oil feed stream. Since a large percentage of the fuel actually consumed in a refinery is directly related to these furnaces, it is little wonder that the industry has been trying for years to perfect a control apparatus which will increase efficiency. This task has been compounded by such factors as furnace design and configuration, air leakages, burner placement and burner size. In the past, people have tried to provide control to the furnaces by adjusting the fuel to oxygen ratio. This was feasible to a certain extent because the fuel to oxygen ratio provides a predictable correlation over a wide range of fuel oils and gas compositions when excess air is present. To do this, Orsat analysis using carbon dioxide and oxygen percentages was used to calculate the amount of excess air which should be injected into the furnace. Although this method worked, the results were not very reliable, even when oxygen analyzers replaced the Orsat analysis. The reason for this was that an oxygen reading alone could not quickly compensate for any drastic changes which might occur within the furnace. Two other disadvantages of the oxygen analyzer were: (1) if it was located in the furnace's stack, air in-leakage could result in gross distortions of the true excess oxygen in the flame cloud, and (2) if it was located in the firebox, the oxygen would be measured at one location only, when in actuality, a typical firebox contains varying oxygen levels. To date, no one has devised an air input control scheme based on radiant section heat transfer which can provide maximum efficiency and thereby more effectively control fuel consumption in the furnace.

An object of this invention is to provide a furnace fuel optimizer which will provide maximum fuel efficiency in a furnace.

Another object of this invention is to provide a furnace fuel optimizer which will more effectively control fuel consumption in a furnace.

A further object of this invention is to provide a method for using the furnace fuel optimizer to minimize excess air and fuel consumption.

Still further, an object of this invention is to reduce the cost of operating a furnace by regulating the amount of combustion air to the furnace.

Other objects and advantages will become apparent to one skilled in the art based upon the ensuing description.

SUMMARY OF THE INVENTION

Briefly, the objects of this invention can be realized by using a furnace equipped with a fuel optimizer for controlling fuel consumption in the furnace. This furnace fuel optimizer is designed for use in a furnace having a radiant section, a convective section and at least one heating coil extending through said sections. This furnace fuel optimizer functions by regulating combustion air to the radiant section in response to an optimum control value. In order for the furnace fuel optimizer to function, the following instruments are needed: a CO analyzer, a draft pressure transmitter and controller, a combustion air controller; temperature sensing means positioned on said heating coil; (a) at the inlet to said convective section, (b) at the outlet from said convective section, and (c) at the outlet from said radiant section.

The furnace fuel optimizer functions as follows, after the furnace is fired to a desired operating temperature and pressure mode with adequate draft and excess air. First, a CO analyzer monitors CO emissions in the departing flue gas and sends a signal to a CO limiter controller. The CO limiter controller compares the measured value to a set point and when, and only when, the measured value exceeds the set point, is a significant output signal transmitted to a high signal selector. The CO set point is selected based upon the Environmental Protection Agency's (EPA) recommended standard for the area where the furnace is located. Although the permissible carbon monoxide content in air will vary according to geographical location and population, it will be advantageous to select a CO set point just below the local, state and federal governmental standards. This will assure compliance with the rules as well as maintaining the most practical economical operation of the furnace.

The high signal selector which receives the signal from the CO limiter controller functions to add combustion air to the furnace which in turn will cause the measured CO variable to decrease to a value below the set point. Second, a draft transmitter monitors the draft below the convective section of the furnace. It is essential for continuous natural draft furnace operation that the pressure immediately below the convective section be less than atmospheric pressure, preferably a pressure of 0.05 inches of water less than atmospheric pressure. A positive pressure below the convective section should be avoided to prevent damage to the furnace. Thirdly, a combustion air controller regulates the air supply to the burners by controlling one of the following: the air duct louvers, the fan speed, the fan inlet guide vanes, the stack damper, or the burner air registers.

During the optimizing mode, combustion air is gradually reduced until the CO content in the flue gas reaches a set value below governmental standards for the area. As air is reduced the heating coil convective section outlet temperature will decrease while the convective section inlet temperature remains constant. At this point delta $T_C$ is computed which is equal to $T_2$-$T_1$. $T_2$ is the temperature of the fluid in the heating coil at the outlet from the convective section and $T_1$ is the temperature of the incoming fluid in the heating coil at the inlet to the convective section. The heating coil radiant section outlet temperature is also recorded, which is usually maintained within a certain specified range. Delta $T_R$ is then computed which is equal to $T_3$-$T_2$. $T_3$ is the temperature of the outgoing fluid in the heating coil at the outlet from the radiant section. Because the total value of delta $T_C$ and delta $T_R$ is constant for a given furnace duty, the ratio $R=\Delta T_R/\Delta T_C$ will provide a method for controlling the furnace. As R is maximized, the furnace approaches the optimum operating conditions. The furnace fuel optimizer arrives at the optimum control value by allowing the incoming air to be reduced until the CO content in the flue gas reaches a set value just below the permissible EPA standards. When this is achieved, reduction of combustion air ceases and the optimizer reads the sensing means with the corresponding temperatures $T_1$, $T_2$ and $T_3$. The optimizer then computes an R ratio and multiplies this value by M to obtain an optimum control value hereinafter referred to as R optimum.

M is a number selected by the operator which will vary depending upon the design and construction of each furnace. M is any number between 0.80 and 1.0, preferably selected as close to 1.0 as possible without exceeding the furnace's specified maximum bridgewall temperature, the maximum allowable tube skin temperature and without excessive flame impingement on the tubes. An acceptable M value will be readily apparent to the operator after several trial runs.

After the R optimum value is obtained, the furnace fuel optimizer shifts from the optimizing mode to the run mode during which the optimizer regulates the combustion air to maintain a constant R optimum. This allows the furnace to operate more efficiently at the most effective fuel-air ratio thereby decreasing operating expenses.

DETAILED DESCRIPTION OF THE INVENTION

Figure 1:
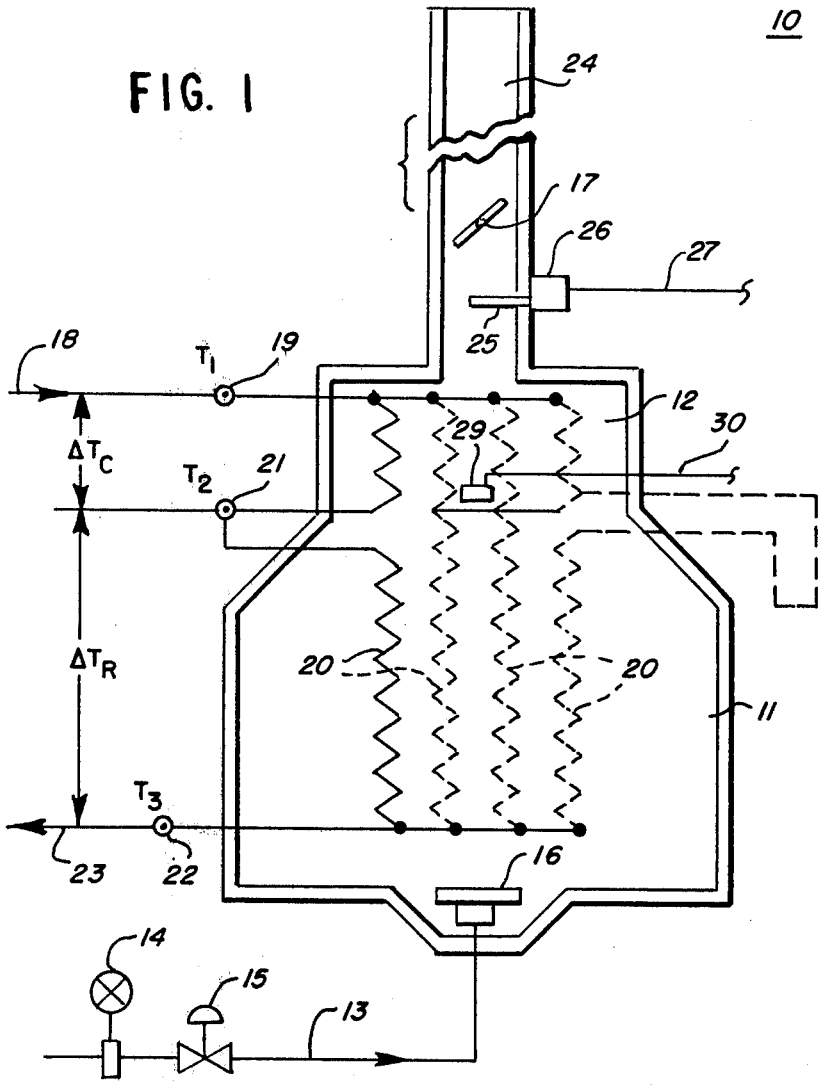
FIG. 1 is a schematic diagram of a furnace having a radiant section, a convective section and at least one heating coil extending through both sections.
Figure 1:
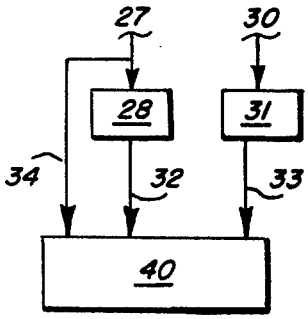

FIG. 1 shows furnace 10 which can be either a single cell or a multicell industrial furnace having radiant section 11 and convective section 12. The word furnace, as used hereinafter, will include any natural draft or pressured apparatus in which heat is liberated by the combustion of fuel within a internally insulated enclosure. Some typical names used to identify such furnaces are: process heaters, process furnaces, fired heaters, and direct-fired heaters. Commonly, these furnaces have one or more banks of hollow tubular heating coils arranged about the interior as well as along the walls and ceiling of radiant section 11 and convective section 12 for the purpose of conducting a fluid, either liquid or gas, through them which is to be elevated in temperature. Hollow tubular heating coils 20 pass into and out of convective section 12 and radiant section 11 and contain a steady flow of a fluid, which when heated can be used in various refinery processes. A typical use of the heated fluid is to preheat a feed stream to a fractionation tower.

In FIG. 1, fuel is fed to burner 16 via line 13 having fuel flow indicator 14 and control valve 15 located thereon. Burner 16 can consist of one or more burners located on the floor, sides or ceiling of radiant section 11. Incoming combustion air to burner 16 is controlled by furnace fuel optimizer 40 which can regulate any of the following, stack damper 17, the inlet guide vanes on the forced draft or induced draft fans (not shown), by regulating the fan speed or by changing the position of the air duct louvers (also not shown). The amount of air introduced to burner 16 will determine the flame temperature and the radiation intensity, as well as the amount of fuel consumed by the furnace. As combustion occurs in burner 16, heat is liberated and dissipates upward past heating coils 20 which extend through both radiant section 11 and convective section 12. Heating coils 20 are filled with a flowing fluid, either liquid or gas, which is being elevated in temperature. Typical fluids include crude oil, reduced crude oil, reboiler oil, naphtha, hydrocarbons and water. The exact arrangement of heating coils 20 within furnace 10 is not controlling but a circuitously arranged configuration is most commonly encountered.

As the heat rises from burner 16 it is transferred to heating coils 20 by radiation and proceeds to heat up the material flowing therein. A significant amount of the heat liberated by burner 16 is transferred to heating coils 20 with the remaining heat passing into convective section 12. The fluid enters heating coils 20 through inlet line 18 having thermocouple 19 positioned thereon. Thermocouples are depicted as the sensing means in FIG. 1 although other devices can be employed. The fluid flows in heating coils 20 through convective section 12 to radiant section 11. Thermocouple 21 is positioned on heating coil 20 at the division between convective section 12 and radiant section 11. When only one heating coil 20 is present, it is practical to design a coil configuration so that the entire coil remains within furnace 10 and extends through both convective section 12 and radiant section 11. When multiple coils, for example six or eight separate coils, are present it is frequently necessary in order to obtain proper heat distribution that some of the coils extend out from the furnace at convective section 12 and form an external loop before entering radiant section 11. This external loop is known in the industry as a jump-over and most industrial furnaces which utilize multiple coils exhibit several of these loops. In such a configuration thermocouple 21 is positioned outside furnace 10 on the external portion of heating coil 20. This is advantageous because it allows for easy reading and maintenance of thermocouple 21. Depending on design, heating coil 20 either continues directly into radiant section 11 from convective section 12 or enters radiant section 11 from a jump-over and then exits from the lower portion of radiant section 11. Thermocouple 22 is positioned on outlet line 23 and monitors the temperature of the exiting fluid. It is feasible to place a thermocouple on the outlet line of each coil if more accurate measurements are required but experience has shown that the temperature fluctuation of the exiting fluid in the multiple coils varies less than 5% of the mean temperature.

The unrecovered heat and flue gases rise upward and out into the atmosphere through exhaust stack 24 which houses a stack damper 17. CO analyzer probe 25 which is located in stack 24 or in a flue gas duct (not shown) contains CO transmitter 26 and is used to monitor the CO content in the exiting flue gas. CO transmitter 26 is connected via line 27 to CO limiter controller 28 whose function will be explained in detail in the description to FIG. 2. A draft pressure transmitter 29 positioned at the entrance to convective section 12 is connected via line 30 to draft limiter controller 31. Draft limiter controller 31 is designed to prevent the draft below convective section 12 from diminishing to less than −0.05 inches of water. Draft limiter controller 31 is strictly a limiting device and transmits a signficant signal to furnace fuel optimizer 40 only when the pressure sensed by draft pressure transmitter 29 is less than −0.05 inches of water. This point is further explained in the description to FIG. 2. This draft controlling protection is required for all natural draft furnaces designed for negative pressure. When draft limiter controller 31 interrupts optimization, gradual manual reduction of either the air register openings or of the combustion air duct damper opening will restore the draft and permit optimization to resume.

Furnace fuel optimizer 40 which is designed to regulate the air input to burner 16 can utilize a microprocessor, a computer or an analog control means. By adjusting the amount of air introduced to furnace 10 one can minimize fuel consumption and maximize furnace efficiency. The amount of air together with the available fuel will determine combustion efficiency.

Figure 2:
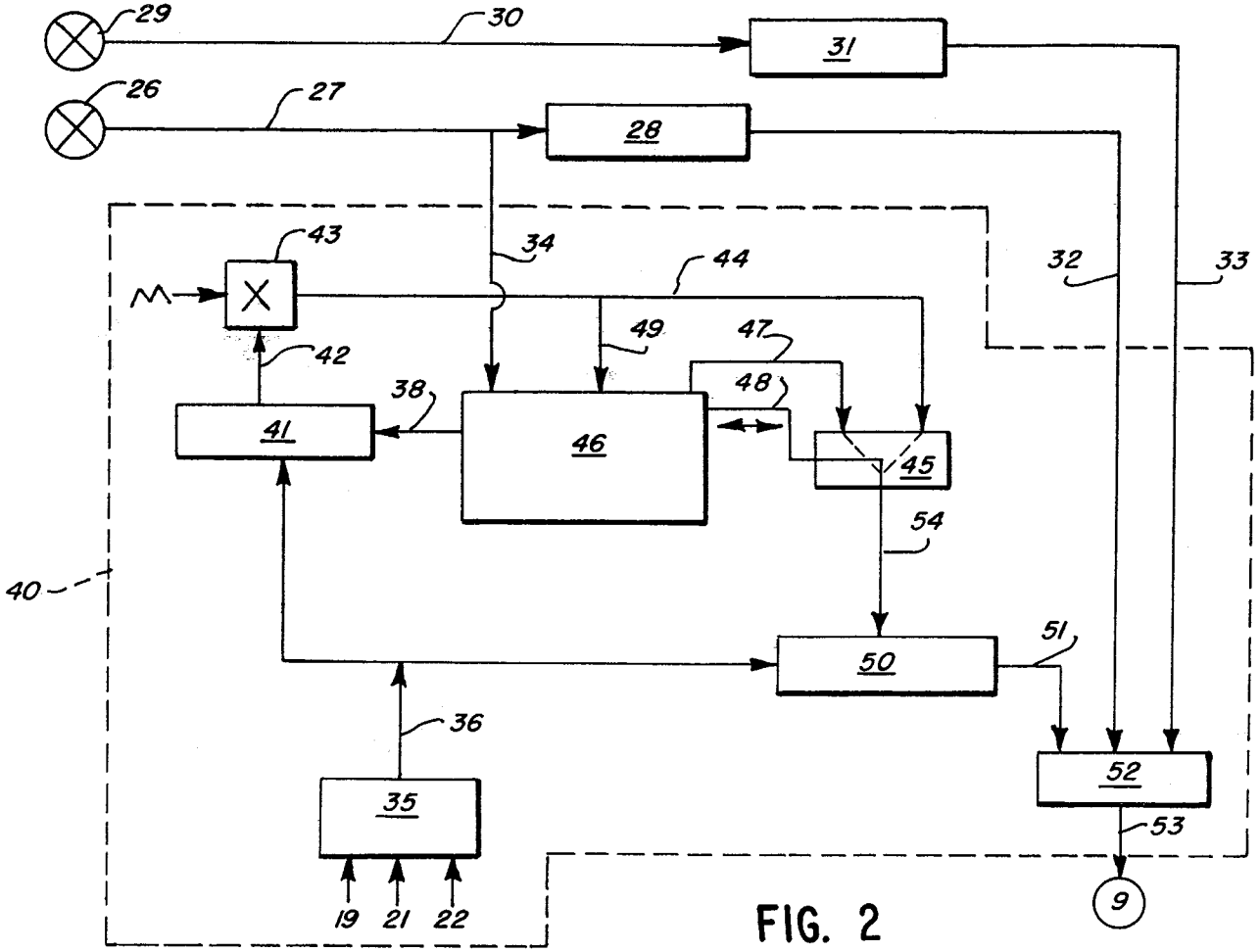
FIG. 2 is a block diagram of the instrumentation scheme using a radiant section R ratio value.

FIG. 2 shows a block diagram depicting the functional operations of furnace fuel optimizer 40 having a microprocessor as the control means and using thermocouples to record the temperature of the fluid in the heating coils. Furnace fuel optimizer 40 functions as follows: first, furnace 10 is fired and brought onstream, operating in a desired temperature and pressure mode. The fluid (liquid or gas) contained in heating coils 20 is flowing before furnace 10 is fired to insure that no internal parts are damaged. With furnace 10 in operation, having adequate draft and excess air, the optimizing cycle begins. Combustion air is gradually reduced while both the CO content in the exiting flue gas and the draft below convective section 12 are monitored. CO transmitter 26 relays a signal via lines 27 and 34 to CO limiter controller 28 and microprocessor 46, respectively. Both CO limiter controller 28 and microprocessor 46 have CO set points, with the set point of microprocessor 46 being lower than the set point of CO limiter controller 28. The CO set points are arbitrarily selected to correspond to a value equal to or preferably just below the CO standard set for the area by the Environmental Protection Agency or by a state or local government authority. Since the CO standards will vary depending upon geographical location, population density, climate, etc., regulations and standards for each furnace will have to be obtained before a set point is selected. Although almost any CO value equal to or below the governmental standard can be used, it is uneconomical to select a value significantly below the recommended value. When the CO content in the flue gas equals the set point value of microprocessor 46 air reduction ceases and the corresponding temperature values of thermocouples 19, 21 and 22 are recorded and relayed to generator box 35. Thermocouple 19 is positioned on heating coil 20 inlet line 18 to convective section 12 and is preferably located outside of furnace 10. Thermocouple 21 is positioned on heating coil 20 outlet line from convective section 12, preferably at the external jump-over. It is only necessary to use one thermocouple on one of the heating coils at this point but a thermocouple can be placed on each coil or on several of the coils if a large fluctuation in recorded temperatures is noticed. Thermocouples 22 is positioned on heating coil 20 outlet line 23 from radiant section 11. Since the temperature in the multiple coils may vary at this point, it is preferred that a thermocouple be placed on each coil. If so, generator box 35 will convert the measured values from all the outlet coils into an average value and use this value to calculate an R ratio. Generator box 35 receives the incoming value from all the thermocouples and generates an R ratio equal to $T_3-T_2/T_2-T_1$. $T_1$ is the temperature of the incoming fluid recorded by thermocouple 19, $T_2$ is the temperature of the fluid heating coil 20 at the point where it leaves convective section 12. $T_3$ is the temperature of the fluid in heating coil 20 as it leaves radiant section 11 through outlet line 23. The R ratio is equal to the difference of $T_3-T_2$, referred to as delta $T_R$, over $T_2-T_1$, referred to as delta $T_C$. The output signal from generator box 35 is sent via line 36 to sample and hold box 41 which is part of microprocessor 46. Microprocessor 46 instructs sample and hold box 41 via line 38 to read the R ratio which corresponds to the cutoff value. Sample and hold box 41 relays this value via line 42 to multiplication box 43 and instructs multiplication box 43 to multiply the calculated R ratio by M to produce an R optimum value. R optimum is the value at which furnace 10 can most efficiently operate. M is a value arbitrarily selected by the operator, which value is greater than 0.08 but less than 1.0, preferably close to 1.0. M can vary depending upon the design and construction of each furnace but an acceptable value will become readily apparent to the operator after several trial runs. M when multiplied by an R ratio value will yield a number (R optimum) corresponding to a value which is: below said furnace's specified maximum bridgewall temperature, below a maximum allowable tube skin temperature in radiant section 11, and is at a value below where excessive flame impingement on heating coils 20 occurs.

Multiplication box 43 relays the calculated value via line 44 to ramp rate box 45. Ramp rate box 45, which has been receiving a signal via line 47 to gradually reduce air, now receives the output signal in line 44. Signal 44 is the new set point for R ratio controller 50. Ramp rate box 45 transmits this signal via line 54 to R ratio controller 50 which calls for a gradual change of the set point so as not to abruptly upset the furnace. The signal in line 44 is also sent via line 49 to microprocessor 46 which stores the signal for reference in the next optimizing cycle. For example, at the end of a run mode, switch 48 instructs ramp rate box 45 to ignore the incoming signal in line 44 and read line 47. At this point, the optimizing mode has begun and microprocessor 46 will calculate another R optimum value.

The optimizing mode functions at the initial start-up period and is repeated at the beginning of each new cycle. Each cycle may extend for any desired time period and is manually set by the operator and can be changed at any time. For example, an optimizing cycle can be conducted every hour, every 8 hours, every 24 hours, every 3 days, etc. The optimizing mode, which is very short is followed by the run mode for the duration of the cycle. The run mode is continuous except for when the optimizing mode takes over or when an override mechanism, such as a manual adjustment is triggered.

In the run mode a fluid flow, preferably a constant fluid flow, is maintained through heating coils 20, and combustion air is controlled to the furnace by maximizing radiant section heat transfer with respect to convective section heat transfer. The above is accomplished by relaying all incoming values via line 36 to R ratio controller 50 wherein the values are compared to the set point value. While this is occurring, both the CO content in the exiting flue gas and the draft pressure below convective section 12 are monitored. The output signal from R ratio controller 50 is then relayed via line 51 to high signal selector 52 which is turn relays a signal via line 53 to air controller 9 to adjust air input if needed. When the incoming signal via line 36 is less than the calculated set point in R ratio controller 50, a reduction of air is needed to maximize the efficiency of furnace 10 and a signal is relayed to high signal selector 52 instructing it to make the change. When the incoming signal via line 36 equals the set point, a nominal signal is relayed via line 51 to high signal selector 52. High signal selector 52 then selects the largest of the three incoming signals (from CO limiter controller 28, draft limiter controller 31 and R ratio controller 50) and instructs air controller 9 to make an adjustment if necessary. This continuous process of monitoring and comparing recorded values to a calculated set point will continue for the duration of the run cycle. Then another optimization cycle is performed and the process is repeated.

The output signal from CO transmitter 26 which is relayed to CO limiter controller 28 is only utilized in the run mode. If for any reason a high CO value is encountered because of increases in fuel supplied during the run mode, CO limiter controller 28 will take control. Factors such as changes in atmospheric conditions or changes in the charge rate to the furnace can trigger such a high CO content. When, and only when, the CO content value exceeds the set point of CO limiter controller 28 does controller 28 begin to send a signficant signal to high signal selector 52 via line 32 instructing it to override the output of R ratio controller 50 and call for more air. Simultaneously, draft pressure transmitter 29 measures the draft within furnace 10 and relays a signal via line 30 to draft limiter controller 31, also having a set point. This set point is arbitrarily selected depending upon the design and construction of each particular furnace. Again the measured value is compared to the set point and an output signal is generated and conveyed to high signal selector 52 via line 33. When the measured value is greater than the set point a significant signal value is transmitted to high signal selector 52. High signal selector 52 is an instrument which has the capability of receiving and comparing several signals simultaneously and will select only the highest signal, disregarding the rest. It should be noted that the signals from CO limiter controller 28 and draft limiter controller 31 are merely limiting detectors and cannot by themselves influence furnace fuel optimizer 40. The third signal from R ratio controller 50 is the normal governing signal. As an extra precaution, whenever the signal in either lines 32 or 33 exceeds the signal in line 51, a light or alarm will flash or sound, alerting the operator that the signal in line 51 is overridden. This condition calls for manually adding additional air to the furnace to eliminate the override and then repeating the optimization cycle.

Although the invention has been described in detail for the purposes of illustration, it is to be understood that such detail is solely for that purpose and that variations can be made therein by those skilled in the art without departing from the spirit and scope of the invention except as it may be limited by the claims.

I claim:

1. A furnace for heating a fluid having a radiant section, a convective section, and at least one fluid heating coil extending through said sections adapted to conduct said fluid initially through said convective section and finally through said radiant section, and means for optimizing the consumption of fuel in said furnace, said optimizer means comprising:

(a) temperature sensing means associated with said fluid heating coil for sensing the temperatures at the inlet of the convective section, the outlet of the convective section, and the outlet of the radiant section;

(b) a combustion air controller for regulating the flow of air to said furnace;

(c) ratio computing means responsive to the temperatures sensed by said temperature sensing means for computing the ratio of the temperature differential across said radiant section of said fluid heating coil to the temperature differential across said convective section of said fluid heating coil; and (d) means for transmitting the outputs from said temperature sensing means to said computing means and from said computing means to said combustion air controller, whereby said combustion air controller may be operated in response to said computed ratio of the temperature differentials of the radiant and convective sections of said fluid heating coil to maximize radiant section heat transfer.

2. The furnace as described in claim 1 wherein said optimizer means includes a CO analyzer which monitors CO content in the exiting flue gas and a CO limiter controller interconnected between said CO analyzer and said combustion air controller for taking control of said combustion air controller to increase the rate of air supply at such times as said CO analyzer indicates that the CO content in the flue gas exceeds a predetermined set point.

3. The furnace as described in claim 1 wherein said optimizer means includes a draft pressure transmitter and a draft limiter controller, said draft limiter controller being interconnected between said draft pressure transmitter and said combustion air controller for taking control of said combustion air controller at such times as a predetermined draft set point is not achieved.

4. The furnace as described in claim 2 wherein said optimizer means includes a draft pressure transmitter and a draft limiter controller, said draft limiter controller being interconnected between said draft pressure transmitter and said combustion air controller for taking control of said air controller at such times as a predetermined draft set point is not achieved.

5. The furnace as described in claim 4 wherein said optimizer means includes a high signal selector interconnected to receive signals from said ratio computing means, said CO limiter controller and said draft limiter controller for transmitting the highest of the three signals to said combustion air controller whereby it is assured that adequate air supply is provided at all times.

* * * * *

UNITED STATES PATENT OFFICE

CERTIFICATE OF CORRECTION

Patent No. 4,260,363 Dated April 7, 1981

Inventor(s) John R. Cratin

It is certified that error appears in the above-identified patent and that said Letters Patent are hereby corrected as shown below:

| Patent Column | Line | |
|---|---|---|
| 6 | 31 | "0.08" should be --.80-- |

Signed and Sealed this

Fourth Day of August 1981

[SEAL]

Attest:

GERALD J. MOSSINGHOFF

Attesting Officer

Commissioner of Patents and Trademarks